US007554313B1

(12) United States Patent
Leitner

(10) Patent No.: US 7,554,313 B1
(45) Date of Patent: Jun. 30, 2009

(54) APPARATUS AND METHOD FOR START-UP CIRCUIT WITHOUT A START-UP RESISTOR

(75) Inventor: Wade Leitner, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 345 days.

(21) Appl. No.: 11/351,075

(22) Filed: Feb. 9, 2006

(51) Int. Cl.
*G05F 3/16* (2006.01)
*G05F 1/10* (2006.01)

(52) U.S. Cl. ..... 323/315; 323/901; 327/543

(58) Field of Classification Search ..... 323/312–315, 323/901; 327/534, 535, 537–539, 543
See application file for complete search history.

(56) References Cited

U.S. PATENT DOCUMENTS

| | | | | |
|---|---|---|---|---|
| 4,342,926 | A | 8/1982 | Whatley | |
| 5,668,467 | A | 9/1997 | Pease | |
| 5,844,434 | A | 12/1998 | Eschauzier | |
| 6,078,094 | A | 6/2000 | Poplevine et al. | |
| 6,404,252 | B1 | 6/2002 | Wilsch | |
| 6,528,980 | B1 | 3/2003 | Smith | |
| 6,600,361 | B2 * | 7/2003 | Nagaya et al. | 327/538 |
| 6,617,835 | B2 * | 9/2003 | Nishimura | 323/313 |
| 6,737,908 | B2 | 5/2004 | Mottola et al. | |
| 6,806,764 | B2 * | 10/2004 | Inagaki et al. | 327/543 |
| 6,906,581 | B2 * | 6/2005 | Kang et al. | 327/539 |
| 7,071,767 | B2 * | 7/2006 | Ou-yang et al. | 327/539 |
| 7,276,888 | B2 * | 10/2007 | Thiele et al. | 323/282 |

OTHER PUBLICATIONS

Cunha, A. et al. (1998) "An MOS Transistor Model for Analog Circuit Design," IEEE Journal of Solid-State Circuits, 33(10):1510-1519.
Camacho-Galeano, E. et al. (2004) "An Ultra-Low-Power Self-Biased Current Reference," SBCCI '04, Sep. 7-11, 2004, Pernambuco, Brazil, pp. 147-150.
Camacho-Galeano, E. et al. (2005) "A 2-nW 1.1-V Self-Biased Current Reference in CMOS Technology," IEEE Transactions on Circuits and Systems—II:Express Briefs, 52(2):61-65.
Leelasantitham, A. et al. (2004) "A High-Frequency Low-Power All-NMOS All-Current-Mirror Sinusoidal Quadrature Oscillator," TENCON 2004, 2004 IEEE Region 10 Conference, pp. 364-367.
Maghari, N. et al. (2005) "A Dynamic Start-Up Circuit for Low Voltage CMOS Current Mirrors with Power-Down Support," IEEE International Symposium on Circuits and Systems, vol. 5., pp. 4265-4268.
National Semiconductor Data Sheet (2005) "LM1770 Low Voltage SOT23 Synchronous Buck Controller With No External Compensation," pp. 1-14.

* cited by examiner

*Primary Examiner*—Matthew V Nguyen
(74) *Attorney, Agent, or Firm*—Darby & Darby P.C.; Matthew M. Gaffney

(57) ABSTRACT

A start-up circuit is provided. In one embodiment, the start-up circuit operates as follows. In this embodiment, the start-up circuit includes a depletion-mode PMOS transistor and an NMOS switch. The NMOS switch is coupled between ground and a common gate node of a PMOS current mirror. At start-up, the depletion-mode transistor provides a DC path to pull up the gate of the NMOS switch. Accordingly, at start-up, the NMOS switch pulls the common gate of the PMOS current mirror to ground. After the PMOS current mirror begins generating current, the NMOS switch is turned off.

12 Claims, 8 Drawing Sheets

APPARATUS AND METHOD FOR START-UP CIRCUIT WITHOUT A START-UP RESISTOR

FIELD OF THE INVENTION

The invention is related to start-up circuits, and in particular, to an apparatus and method for a start-up circuit that does not employ a start-up resistor.

BACKGROUND OF THE INVENTION

Many critical circuits such as band gap references and bias current generators use feedback schemes to regulate at a specified non-zero equilibrium point. However, most, if not all, of these circuits possess an alternate undesirable equilibrium. Under some conditions these circuits do not start but remain in their original zero state. Start-up schemes provide a suitable perturbation that causes these systems to leave the zero state and approach the desired operation point. Typically, large resistors provide a passive dc path into a key node that pulls the circuit away from the zero state. Such a start-up resistor is typically at least 10 mega-Ohms. Some problems typically caused by using start-up resistors are that they occupy large areas of the layout, they usually consume power, and they may perturb the nominal bias point after start-up. Additionally, component variation in the start-up resistor may cause a certain percentage of these circuits not to start.

BRIEF DESCRIPTION OF THE DRAWINGS

Non-limiting and non-exhaustive embodiments of the present invention are described with reference to the following drawings, in which.

DETAILED DESCRIPTION

Figure 1:
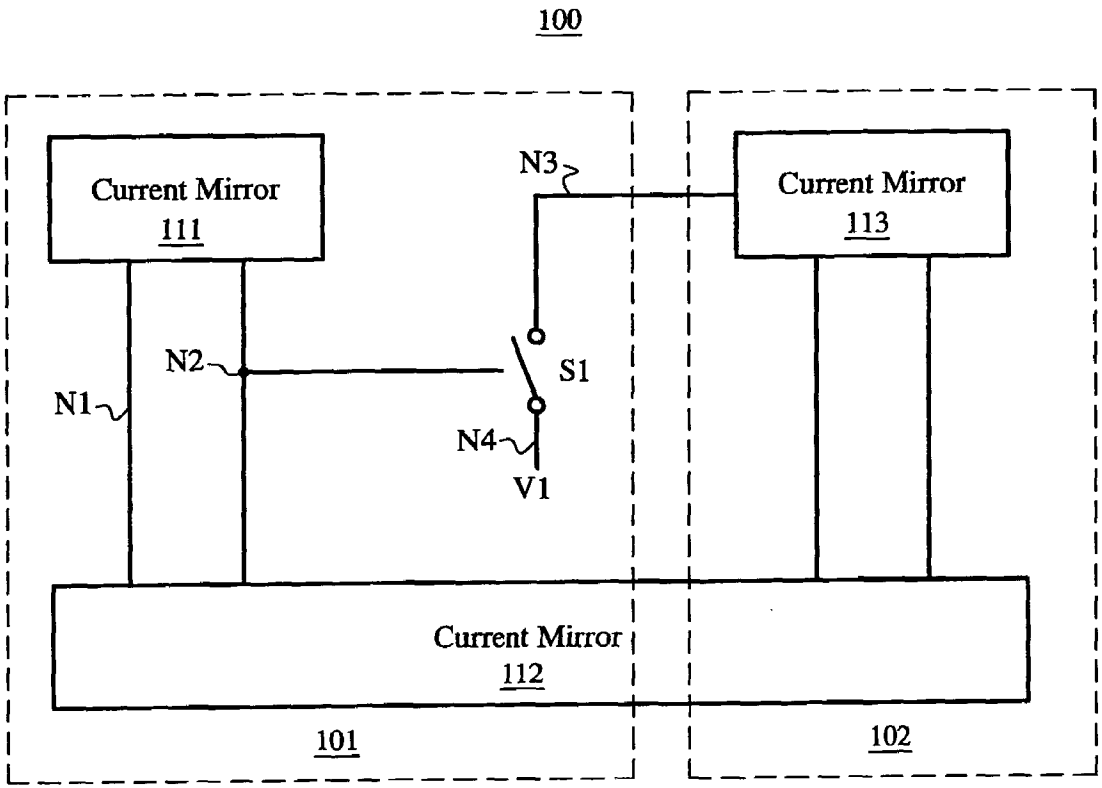
FIG. 1 illustrates a block diagram an embodiment of a circuit for start-up.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference, and the meaning of "in" includes "in" and "on." The phrase "in one embodiment," as used herein does not necessarily refer to the same embodiment, although it may. The term "coupled" means at least either a direct electrical connection between the items connected, or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data, or other signal. Where either a field effect transistor (FET) or a bipolar transistor may be employed as an embodiment of a transistor, the scope of the words "gate", "drain", and "source" includes "base", "collector", and "emitter", respectively, and vice versa.

Briefly stated, the invention is related to a start-up circuit. In one embodiment, the start-up circuit operates as follows. In this embodiment, the start-up circuit includes a depletion-mode PMOS transistor and an NMOS switch. The NMOS switch is coupled between ground and a common gate node of a PMOS current mirror. At start-up, the depletion-mode transistor provides a DC path to pull up the gate of the NMOS switch. Accordingly, at start-up, the NMOS switch pulls the common gate of the PMOS current mirror to ground. After the PMOS current mirror begins generating current, the NMOS switch is turned off. However, the invention is not limited to this embodiment, and other embodiments are within the scope and spirit of the invention.

FIG. 1 illustrates a block diagram an embodiment of a circuit (100) for start-up. Circuit 100 includes start-up circuit 101 and self-biasing current generator circuit 102. Circuit 100 includes switch circuit S1, current mirror 111, and a portion of current mirror 112. Self-biasing current generator circuit 102 includes current mirror 113 and another portion of current mirror 112.

In operation, transistors in current mirror 112 conduct substantially no current at start-up. However, current mirror 111 has a current path at start-up. For example, in one embodiment, current mirror 111 consists of depletion-mode transistors. In one embodiment, current mirror 111 is a p-type current mirror that pulls node N2 up at start-up. In another embodiment, current mirror 111 is an n-type current mirror that pulls node N2 down at start-up.

In one embodiment, an input of current mirror 111 is coupled to node N1, and an output of current mirror 111 is coupled to node N2. Further, switch circuit S1 is coupled between node N3 and node N4, and a control input of switch circuit S1 is coupled to node N2. At start up, current mirror 111 pulls node N2 to a voltage level that causes switch circuit S1 to turn on. When switch circuit S1 is turned on, node N3 is coupled to voltage V1 at node N4. Node N3 is connected to the common gate of either current mirror 113 or current mirror 112. In any case, the closing of switch circuit S1 causes current to begin flowing in the current mirror to which it is connected at the common gate.

For example, in one embodiment, current mirror 113 is a p-type current mirror, and node N3 is connected to the common gate of current mirror 113. In this embodiment, when switch circuit S1 is closed, voltage V1 is connected to the common gate of current mirror 113, and V1 is a voltage (e.g. 0V) such that Vsg (or Veb, in the case of a bipolar transistor) of the transistors in current mirror 113 is relatively large. Accordingly, current is generated by current mirror 113. However, the invention is not limited to this embodiment.

As discussed above, in one embodiment, current is accordingly started in current mirror 113. In this embodiment, this causes current mirror 112 to begin conducting current as well.

In one embodiment, the transistors in current mirror 112 are sized so that current demanded by the transistor within current mirror 112 that is coupled to node N2 demands more current than provided at node N2 by current mirror 111. Accordingly, in this embodiment, the transistor in current mirror 112 that is coupled to node N2 operates in triode (in the case of a field effect transistor), pulling node N2 to a voltage level that causes switch circuit S1 off.

Accordingly, at start-up, switch circuit S1 is turned on so that current is generated in self-biasing current generator circuit 102. Then, after the current is started up, switch circuit S1 is turned off.

Figure 2:
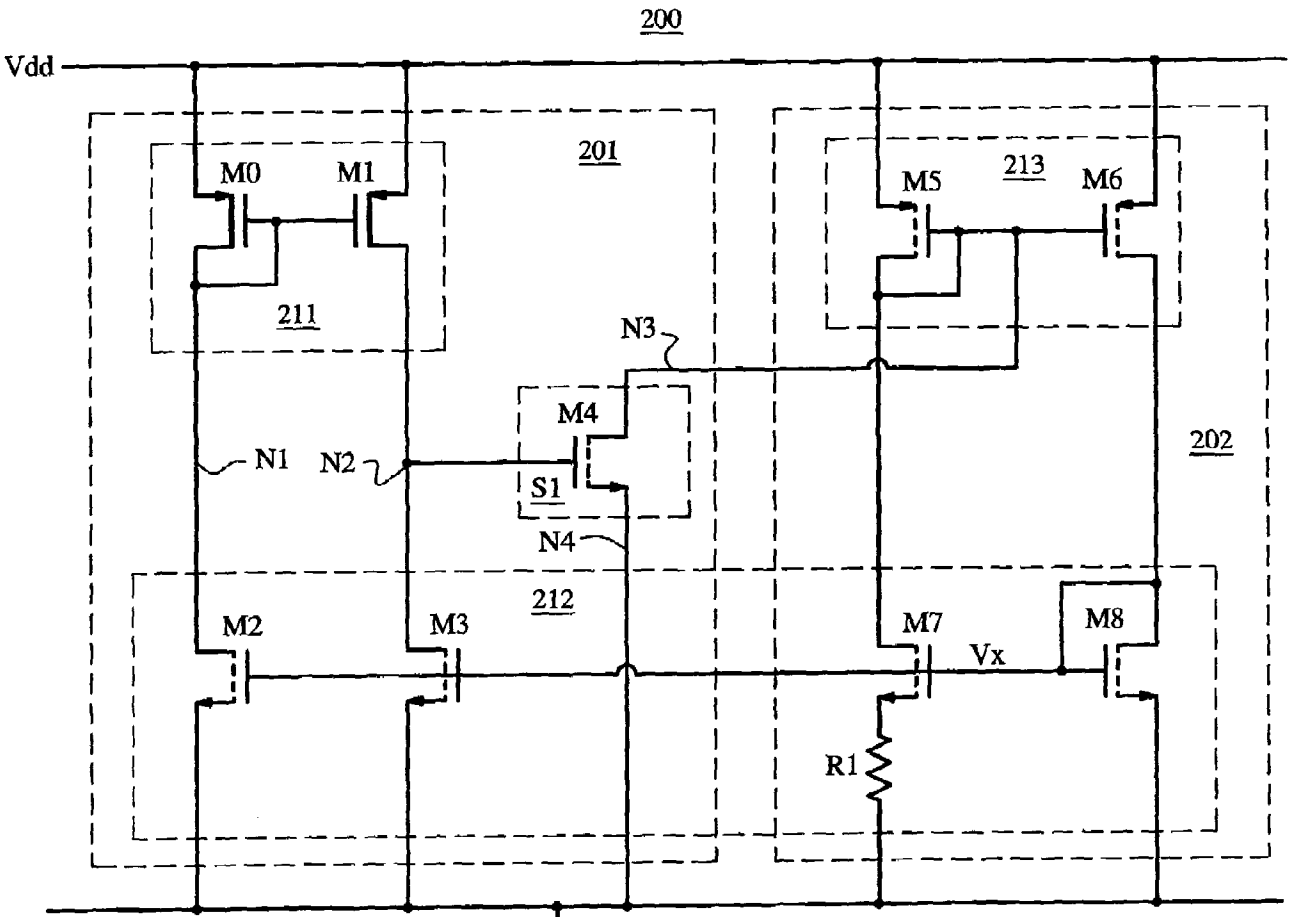
FIG. 2 shows a schematic diagram of an embodiment of the circuit of FIG. 1.

FIG. 2 shows a schematic diagram of an embodiment of circuit 200, which may be employed as an embodiment of circuit 100 of FIG. 1. Current mirror 211 includes transistors M0 and M1. Switch circuit S1 includes transistor M4. Further, current mirror 212 includes transistors M2, M3, M7, and M8. Current mirror 213 includes transistor M5 and transistor M6.

In one embodiment, transistor M5 and M6 have a 1:1 ratio, and transistors M7 and M8 have an N:1 ratio. In this embodiment, $$\frac{1}{k(R1)^2}\left(1-\frac{1}{\sqrt{N}}\right)^2 = i_{M5} = i_{M6} \qquad \text{(Equation 1)}$$

Figure 3:
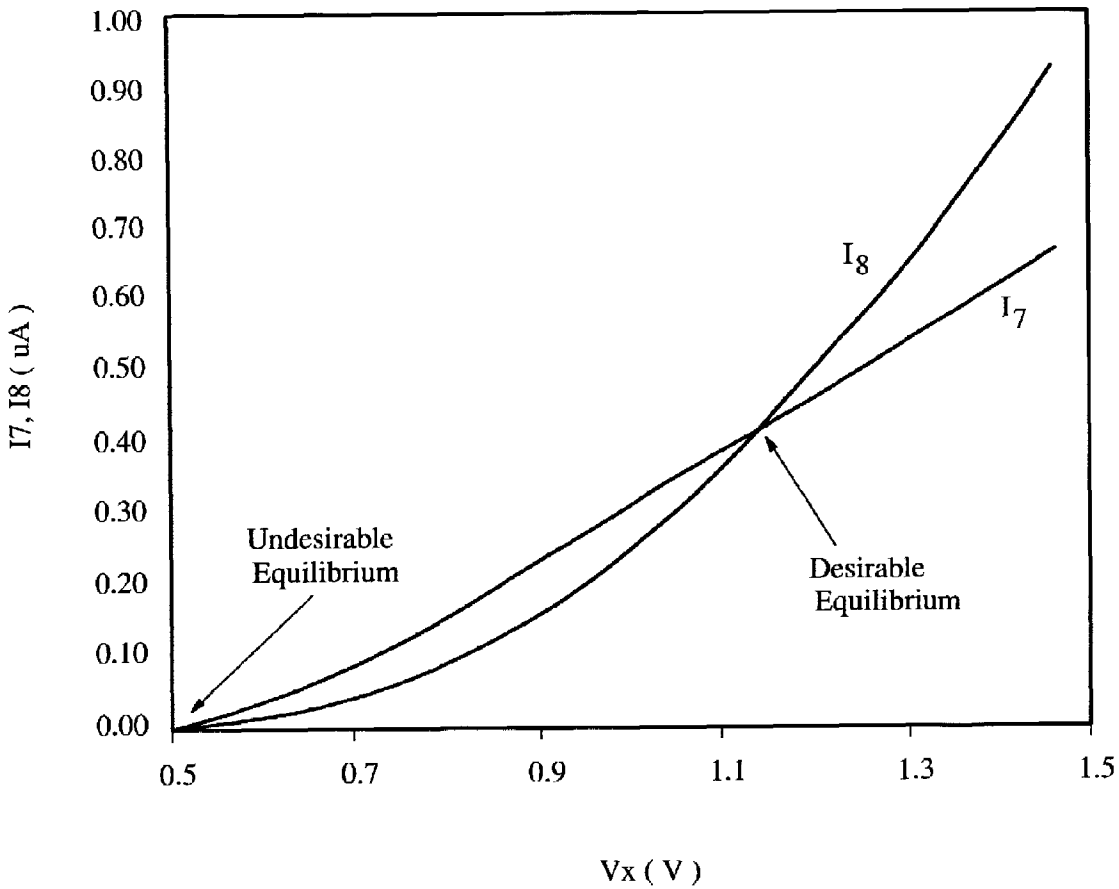
FIG. 3 illustrates a graph of current over voltage showing two equilibrium states for the circuit of FIG. 2.

FIG. 3 shows a plot of $I_{M7}$ vs. $V_X$ superimposed on a plot of $I_{M8}$ vs. $V_X$. Normal operation is established when voltage $V_x$ forces $I_{M8}=I_{M7}$. When $I_{M8}=I_{M7}$, the circuit is in an equilibrium state.

At $V_X=0$ the equilibrium is undesirable while $V_x=V_c$ is the desired equilibrium set point. Below the set point, an increase in $I_{M7}$ results in a value of $I_{M8}$ that increases $V_x$. Above the set point, increasing $I_{M7}$ results in a value of $I_{M8}$ that requires a decrease in $V_x$. Accordingly, by perturbing $I_{M7}$ or $I_{M8}$ away from zero, the circuit moves away from the undesired equilibrium to the desired point given by Equation 1. In the absence of a scheme to start the current generator, un-expected parasitic impedances could pull the gates of M5 and M6 up to the positive rail while analogous impedances pull the gates of M7 and M8 to ground. Start-up circuit 201 overcomes these parasitic impedances.

Enhancement-mode transistors M2, M3, M7, and M8 are cut-off at start-up. However, in the embodiment illustrated in FIG. 2, transistor M1 is a depletion mode FET. Accordingly, as connected in FIG. 2, at start up, there is a DC path to pull the gate of M4 up. M4 then pulls the gate of M5 down and starts self-biasing current generator circuit 202. By avoiding the use of a large start-up resistor, the embodiment of circuit 200 illustrated in FIG. 2 occupies a relatively small region of the layout area.

In one embodiment, the current mirror ratio of M3 to M2 is significantly greater than the ratio of M1 to M0 (e.g., three times as large). For example, in one embodiment, current mirror 211 is a 1:1 current mirror, and the current mirror ratio for transistor M3 to transistor M2 is a 3:1 ratio.

Initially, very little current flows through M7, but a relatively large current flows in M8. This sets up a bias voltage that causes M3 to demand more (e.g. 3 times more) than the current present in M2. The mirror configuration of M0 and M1 causes M1 to source less than the current demanded by M3. Accordingly, in this embodiment, M3 is in deep triode, so node N2 falls to a voltage near ground. When node N2 falls, M4 is cut-off and the current generator finds its equilibrium point. This sets the amount of current drawn by M2 and M3 to be controlled by M8. In one embodiment, M2 and M3 are relatively longer and narrower than M8 (but wide and short enough to provide smaller impedance than M1), so that little current will flow after start up. Once transistor M4 is cut-off, $I_{M5}$ is independent of the start-up circuit so that the self-biasing current generator is unperturbed by the start-up circuit.

The current conducted by M0 and M1 is determined by the current sources whose strength is set by the M5-M8 feedback loop. Thus, there is no need to tradeoff the strength of the start-up function against the steady state power dissipation of the start-up circuit. In many conventional start-up schemes, this tradeoff forces constraints on the size of the pull up resistor or the length of the channel in the transistor. However, there may be wide variation in the leakage through these FETs over process and temperature which, in turn, requires the use of smaller resistors and thus wastes more current. Typically, the limitation on current that can be wasted in start-up results in some fraction of parts that fail to start. Circuit 200, however, does not suffer from this sensitivity to component variations in the start-up circuit.

Figure 8:
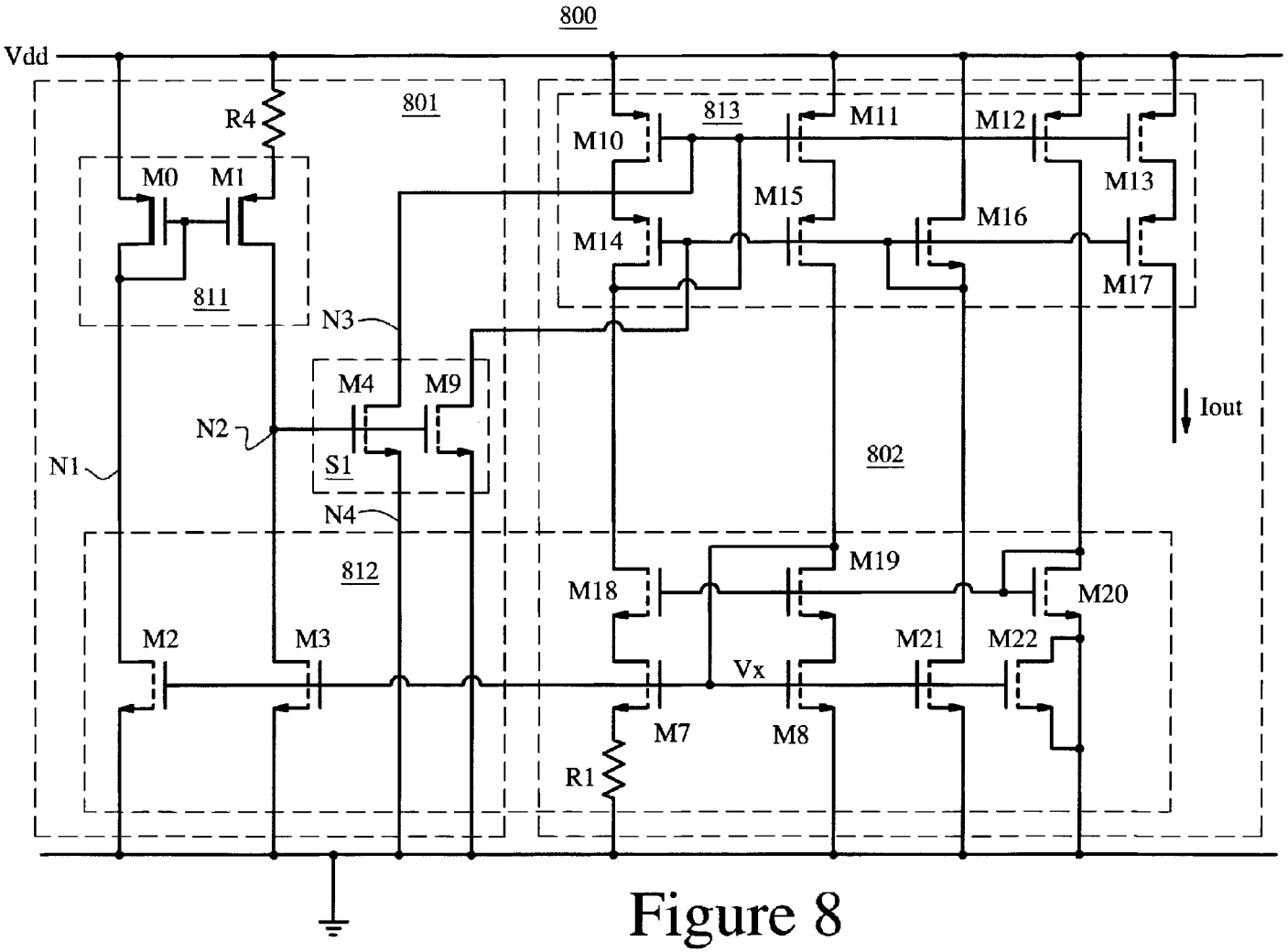
FIG. 8 shows a schematic diagram of another embodiment of the circuit of FIG. 2, arranged in accordance with aspects of the invention.

An output current may be obtained from self-biasing current generator circuit 202 by including one or more additional current mirror transistors in current mirror 212 and/or current mirror 213, as shown in FIG. 8 in one embodiment.

Although FIG. 2 illustrates one embodiment of circuit 200, the invention is not so limited. Many other variations are within the scope and spirit of the invention. For example, although switch circuit SI is implemented as an NMOSFET in FIG. 2, in other embodiments, transistor M4 may be replaced by another type of switch circuit, such as a different type of FET other than a MOSFET, a bipolar transistor, or the like. Also, rather than an n-type transistor, transistor M4 may be replaced with an p-type transistor with an inverter at the gate of the transistor. These variations and others are within the scope and spirit of the invention.

Similarly, although full depletion-mode transistors are illustrated for the transistors in current mirror 211 in FIG. 2, in other embodiments, transistors M0 and M1 may be semi-depletion-mode transistors rather than full depletion-mode transistors, as long as sufficient leakage current is provided to node N2 at start-up. Also, enhancement-mode transistors combined with a current path to Vdd may be used in current mirror 211, as illustrated in FIG. 4 in one embodiment.

Figure 5:
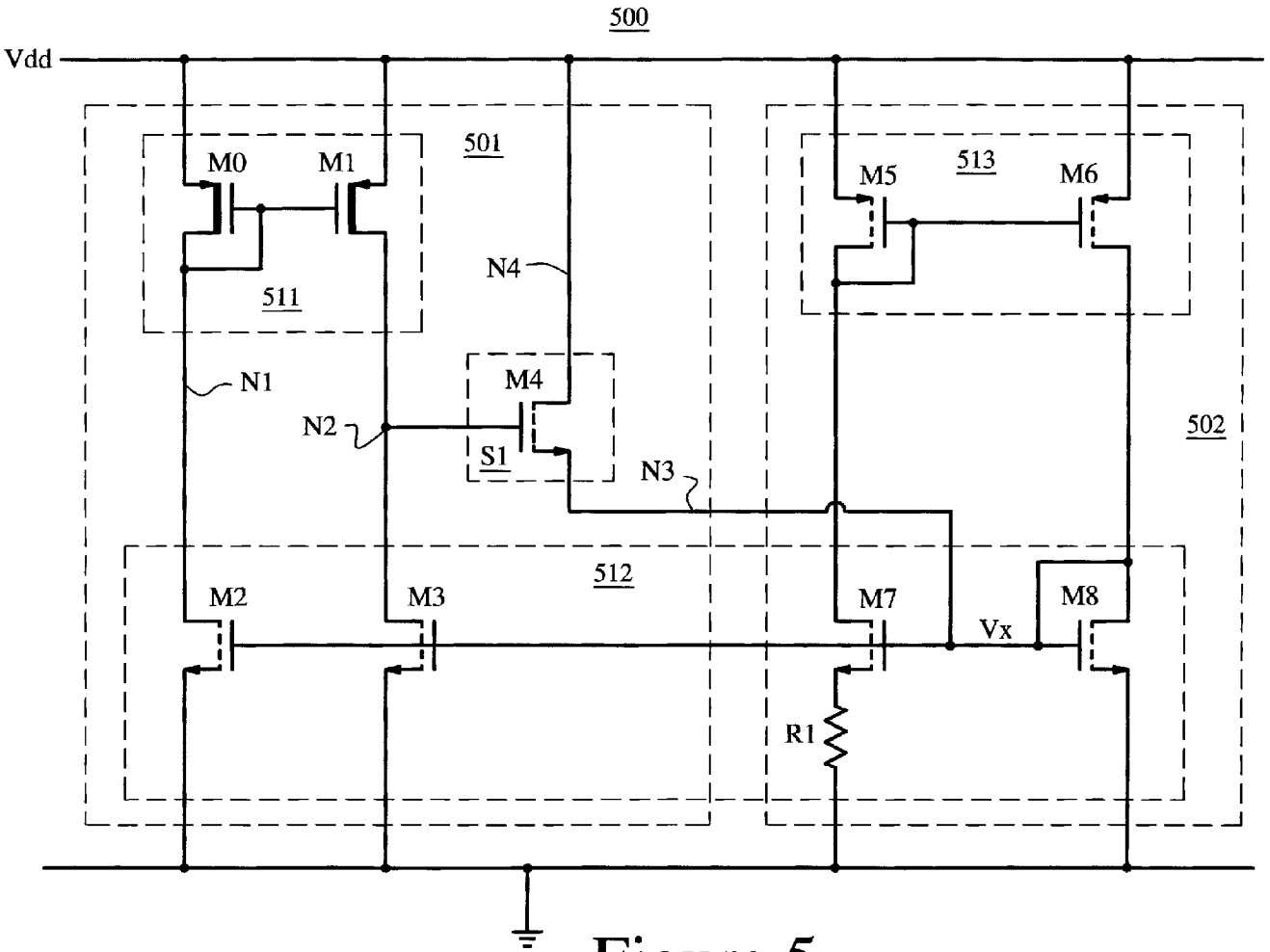
FIG. 5 schematically illustrates a diagram of another embodiment of the circuit of FIG. 2.
Figure 6:
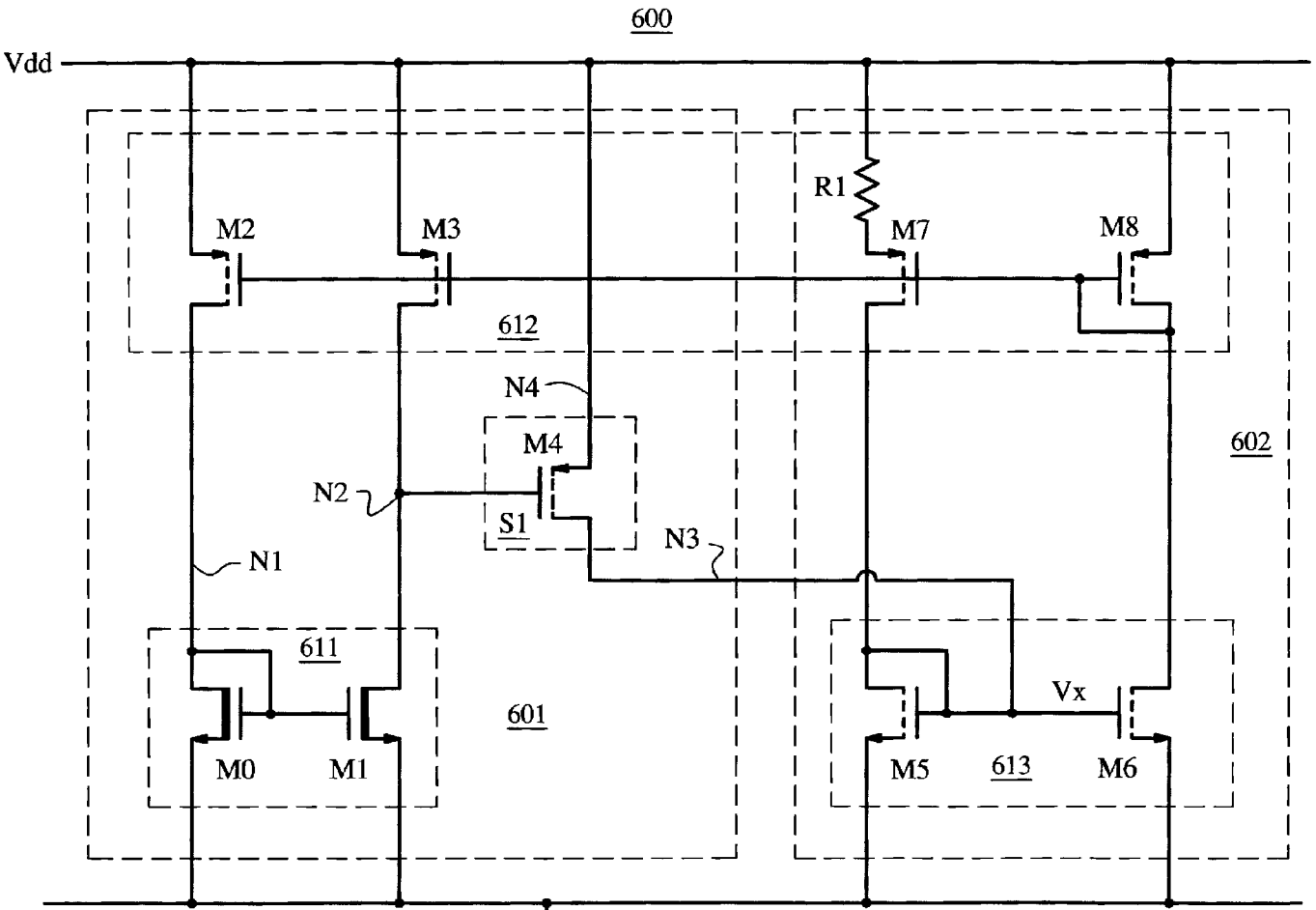
FIG. 6 shows a schematic diagram of another embodiment of the circuit of FIG. 2.

Also, although switch circuit SI is coupled to the common gate of current mirror 213 in the embodiment illustrated in FIG. 2, in another embodiment, switch circuit S1 is instead coupled to the common gate of current mirror 212, as shown in FIG. 5 in one embodiment. Further, for any of the circuits described and variations thereof, the entire circuit may be "turned upside down", as shown in FIG. 6 in one embodiment. FIG. 2 illustrates a low power supply rail, (e.g. ground or Vss), and a high power supply rail (e.g. Vdd). If the circuit is turned upside down, each p-type transistor having its source coupled to the low power supply rail may be replaced with an n-type transistor having its source coupled to the high power supply rail, and so on.

Figure 7:
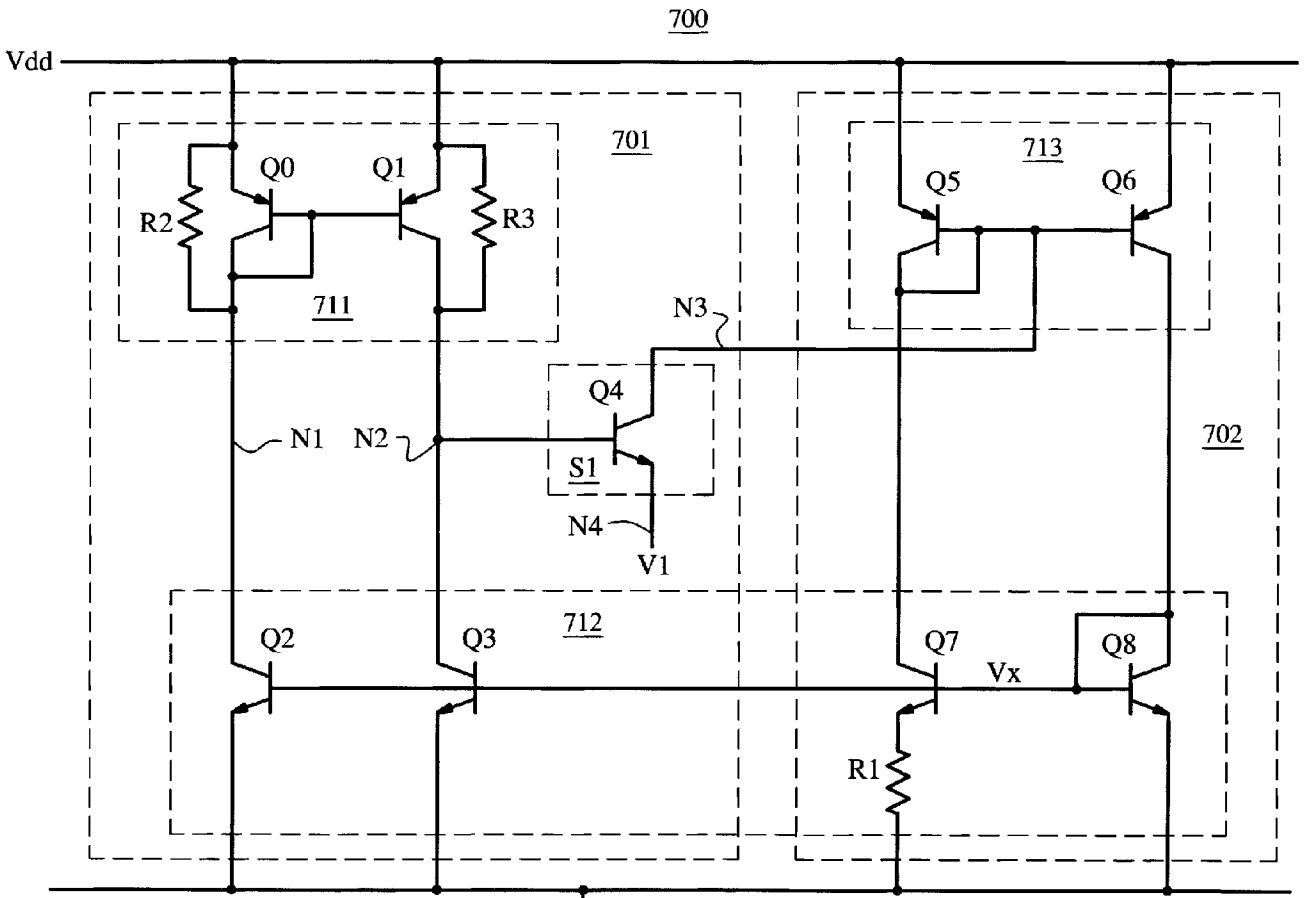
FIG. 7 schematically illustrates a diagram of another embodiment of the circuit of FIG.2.

Similarly, although MOSFET transistors are illustrated in FIG. 2, in other embodiments, other types of transistors, such as a different type of field effect transistor, a bipolar transistor, or the like may be used in place of one or more of the transistors, as illustrated in FIG. 7 in one embodiment. Further, although a particular topology is illustrated in FIG. 2, other embodiments may include more or less components. For example, in one embodiment, cascodes, resistors, and/or other components may be included in the circuit, as shown in FIG. 8 in one embodiment.

Figure 4:
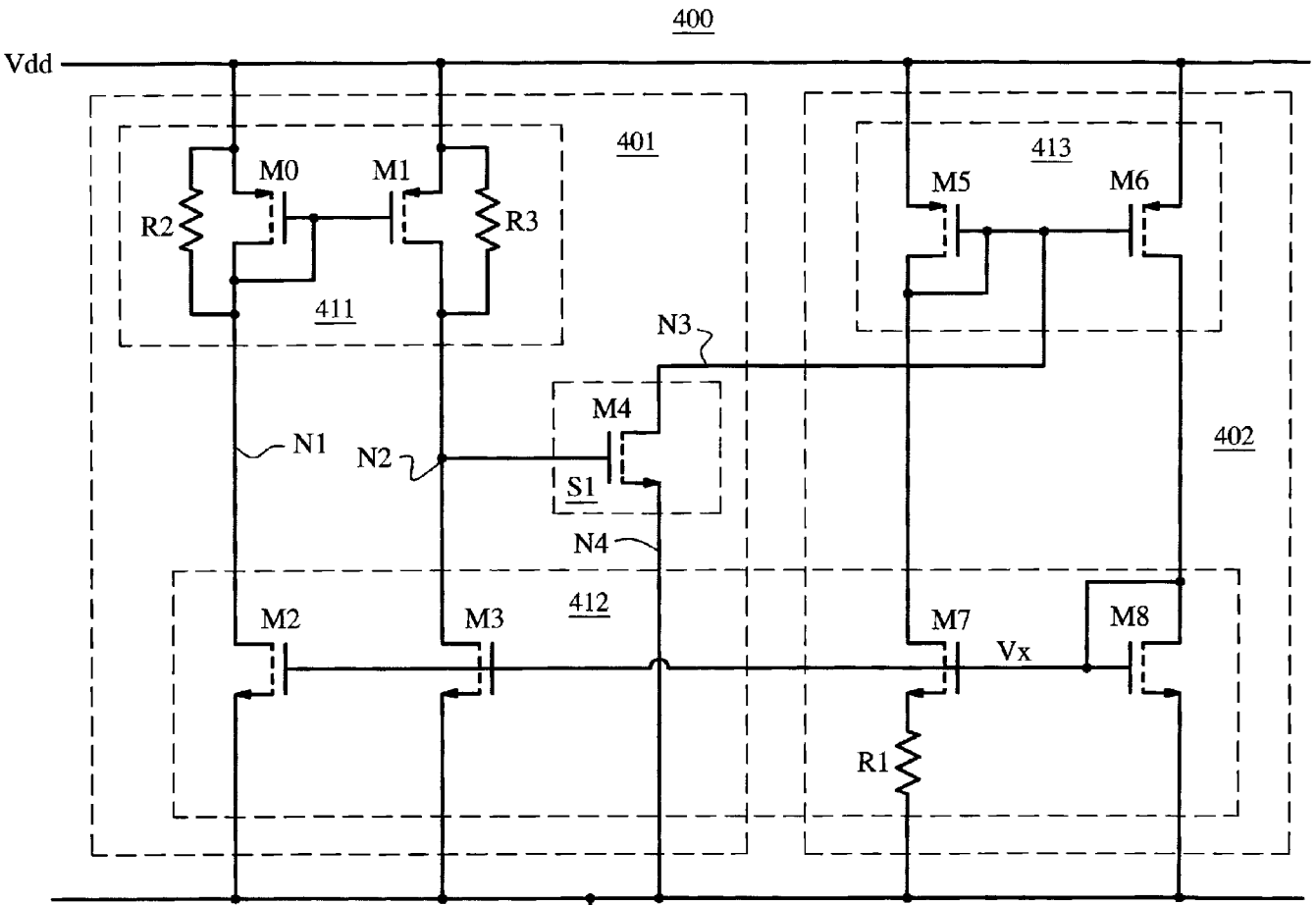
FIG. 4 shows a schematic diagram of another embodiment of the circuit of FIG. 2.

FIG. 4 shows a schematic diagram of an embodiment of circuit 400, which may be employed as an embodiment of circuit 200 of FIG. 2. Current mirror 411 further includes resistors R2 and R3. Resistor R2 is coupled in parallel with transistor M0, and resistor M3 is coupled in parallel with transistor M1. Unlike the embodiment illustrated in FIG. 2, in circuit 400, transistors M0 and M1 are enhancement mode FETs. Although the embodiment illustrated in FIG. 4 lacks the advantage of small layout by excluding large resistors, it does have the advantage of being relatively insensitive to component variations, unlike schemes that use a start-up resistor.

FIG. 5 schematically illustrates a diagram of an embodiment of circuit 500, which may be employed as an embodiment of circuit 200 of FIG. 2. In circuit 500, node N4 is coupled to Vdd, and node N3 is connected to the common gate of current mirror 512 rather than the common gate of current mirror 513.

FIG. 6 shows a schematic diagram of an embodiment of circuit 600, which may be employed as an embodiment of circuit of 200 of FIG. 2.

FIG. 7 shows a schematic diagram of an embodiment of circuit 700, which may be employed as an embodiment of circuit of 200 of FIG. 2. Circuit 700 employs bipolar transistors rather than FETs.

FIG. 8 shows a schematic diagram of an embodiment of circuit 800, which may be employed as an embodiment of circuit of 200 of FIG. 2. Start-up circuit 801 further includes resistor R4. In one embodiment, resistor R4 is a 200 kilo-Ohm resistor. Switch circuit S1 further includes transistor M9. Current mirror 813 further includes transistors M10-M17. Also, transistors M14, M15, and M17 operate as cascode transistors. Transistor M13 is operable to provide output current Iout. Current mirror 812 further includes transistors M18-M22. Transistors M18 and M19 operate as cascode transistors.

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. A circuit for start-up, comprising:

a first current mirror including at least an input that is coupled to a first node and an output that is coupled to a second node, wherein the first current mirror includes a first transistor that is coupled to the first node and a second transistor that is coupled to the second node;

a second current mirror, including:

a third transistor that is coupled to the first node; and a fourth transistor that is coupled to the second node, wherein a current mirror ratio of the fourth transistor to the third transistor is significantly greater than a current mirror ratio of the second transistor to the first transistor; and a switch circuit having at least a control input that is coupled to the second node.

2. The circuit of claim 1, wherein the current mirror ratio of the fourth transistor to the third transistor is at least three times as great as the current mirror ratio of the second transistor to the first transistor.

3. The circuit of claim 1, wherein the first transistor is a full depletion-mode transistor, and wherein the second transistor is a full depletion-mode transistor.

4. The circuit of claim 1, wherein the first transistor is a semi-depletion-mode transistor, and wherein the second transistor is a semi-depletion-mode transistor.

5. The circuit of claim 1, further comprising:

a resistor that is coupled in parallel with the first transistor, wherein the first transistor is an enhancement-mode transistor; and another resistor that is coupled in parallel with the second transistor, wherein the second transistor is an enhancement-mode transistor.

6. The circuit of claim 1, further comprising:

a third current mirror, wherein the switch circuit is coupled to a common gate of the third current mirror, and wherein the second current mirror further includes a fifth transistor that is coupled to the third current mirror.

7. The circuit of claim 6, further comprising a resistor, wherein the second current mirror further includes a sixth transistor having at least: a gate that is coupled to a gate of the fifth transistor, a drain that is coupled to an input of the third current mirror, and a source that is coupled to the resistor.

8. The circuit of claim 7, wherein the second current mirror is coupled to a third node; and wherein the third current mirror includes:

an seventh transistor having at least a gate that is coupled to the common gate of the third current mirror, a source that is coupled to a fourth node, and a drain that is coupled to the drain of the sixth transistor;

a eighth transistor having at least a gate that is coupled to the gate of the seventh transistor, a source that is coupled to the fourth node, and a drain that is coupled to the drain of the fifth transistor; and a ninth transistor having at least a gate that is coupled to the gate of the seventh transistor, a source that is coupled to the fourth node, and a drain, wherein the ninth transistor is operable to provide an output current at the drain of the ninth transistor.

9. The circuit of claim 7, wherein the third transistor, the fourth transistor, and the fifth transistor each have at least a gate, a drain, and a source; the gate of the fourth transistor is coupled to the gate of the third transistor; the gate of the fifth transistor is coupled to the gate of the fifth transistor; the source of the third transistor is coupled to a third node; the source of the fourth transistor is coupled to the third node; the source of fifth transistor is coupled to the third node; and wherein the resistor is coupled between the third node and the source of the sixth transistor.

10. The circuit of claim 9, wherein the switch circuit is coupled between the third node and the common gate of the third current mirror.

11. The circuit of claim 9, wherein the switch circuit includes a seventh transistor having at least a gate that is coupled to the second node, a source that is coupled to the common gate of the third current mirror, and a drain that is coupled to the third node.

12. The circuit of claim 9, wherein the second current mirror further includes:

a first cascode transistor having at least a gate, a source that is coupled to the drain of the sixth transistor, and a drain that is coupled to the input of the third current mirror; and another cascode transistor having at least a gate that is coupled to the gate of the first cascode transistor; a source that is coupled to the drain of the fifth transistor; and a drain that is coupled to the third current mirror.

* * * * *

UNITED STATES PATENT AND TRADEMARK OFFICE

CERTIFICATE OF CORRECTION

PATENT NO. : 7,554,313 B1
APPLICATION NO. : 11/351075
DATED : June 30, 2009
INVENTOR(S) : Wade Leitner It is certified that error appears in the above-identified patent and that said Letters Patent is hereby corrected as shown below:

In column 4, line 28, delete "SI" and insert -- S1 --, therefor.

In column 4, line 43, delete "SI" and insert -- S1 --, therefor.

Signed and Sealed this

Fifth Day of January, 2010

David J. Kappos

David J. Kappos
*Director of the United States Patent and Trademark Office*